US006015107A

United States Patent [19]

Stegmeier

[11] Patent Number: 6,015,107

[45] Date of Patent: Jan. 18, 2000

[54] ROLLER ALIGNMENT SYSTEM

[76] Inventor: Bill Stegmeier, 27116 Grummand Ave., Tea, S. Dak. 57064

[21] Appl. No.: 09/204,492

[22] Filed: Dec. 3, 1998

[51] Int. Cl.[7] ..... B02C 4/42

[52] U.S. Cl. ..... 241/101.2; 241/159; 241/234

[58] Field of Search ..... 241/159, 230, 241/231, 232, 233, 234, 235, 101.2

[56] References Cited

U.S. PATENT DOCUMENTS

| | | | |
|---|---|---|---|
| 4,070,886 | 1/1978 | Nyssen . | |
| 4,098,029 | 7/1978 | Shiets . | |
| 4,161,068 | 7/1979 | McMaster . | |
| 4,606,150 | 8/1986 | Grimm . | |
| 4,890,420 | 1/1990 | Azimi . | |
| 4,897,967 | 2/1990 | Maruyama et al. . | |
| 5,060,874 | 10/1991 | Sidney et al. | 241/234 |
| 5,199,182 | 4/1993 | Fowler . | |
| 5,399,125 | 3/1995 | Dozier . | |
| 5,584,752 | 12/1996 | Mizutani . | |

*Primary Examiner*—Mark Rosenbaum
*Attorney, Agent, or Firm*—Kaardal & Associates, PC

[57] ABSTRACT

A new roller alignment system for permitting quick and precise alignment of the rollers. The inventive device includes first and second side subassemblies, and an elongate linking rod. Each side subassembly comprises an adjustment bracket and threaded elongate upper and lower adjustment rods. The adjustment bracket is pivotally coupled a side of a roller grinder housing which abuts an end of a back roller of the roller grinder. The back end of the upper first adjustment rod is extended through the upper end of the first adjustment bracket while the front end of the upper first adjustment rod is positioned adjacent the front of the housing. The front end of the lower first adjustment rod is outwardly extended from the front of the housing. A adjustment nut is threaded on the front end of the lower adjustment rod and a coarse adjustment member is coupled to the front end of the upper adjustment rod. The coarse adjustment member is pivotally mounted on a side of the housing. The linking rod connects the coarse adjustment member of the first subassembly to the coarse adjustment member of the second subassembly.

5 Claims, 4 Drawing Sheets

FIG 5
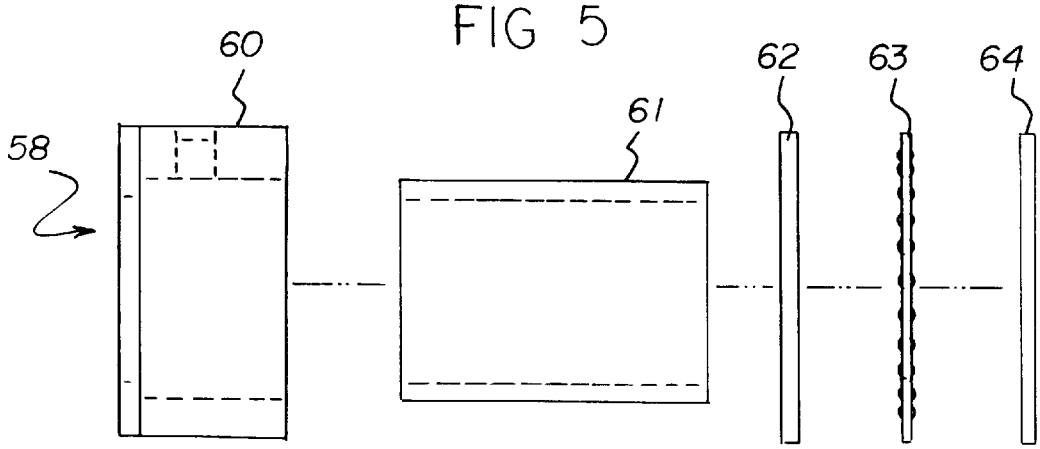
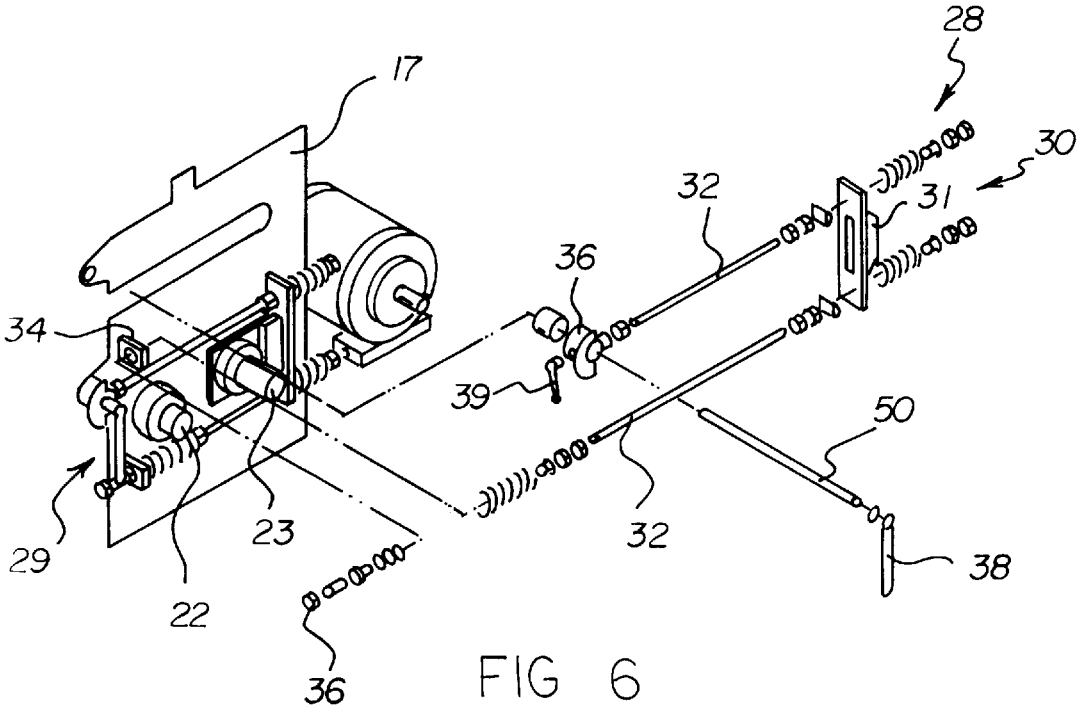
FIG 6

ROLLER ALIGNMENT SYSTEM

BACKGROUND OF THE INVENTION

1. Field of the Invention

The present invention relates to roller grinders and more particularly pertains to a new roller alignment system for permitting quick and precise alignment of the rollers.

2. Description of the Prior Art

The use of roller grinders is known in the prior art. More specifically, roller grinders heretofore devised and utilized are known to consist basically of familiar, expected and obvious structural configurations, notwithstanding the myriad of designs encompassed by the crowded prior art which have been developed for the fulfillment of countless objectives and requirements.

Known prior art roller grinders include U.S. Pat. No. 5,584,752; U.S. Pat. No. 4,890,420; U.S. Pat. No. 4,161,068; U.S. Pat. No. 5,399,125; U.S. Pat. No. 4,897,967; U.S. Pat. No. 4,606,150; U.S. Pat. No. 4,070,886; U.S. Pat. No. 4,098,029; and U.S. Pat. No. 5,199,182.

Current feed grinding conditions often require a roller grinder to be used for grinding a very finely ground feed. In order to achieve this fine of a grind, the rolls must be constantly re-adjusted in order to be kept in parallel alignment with each other. Rolls that become out of alignment will produce feed that is too coarse for its intended purpose. Unfortunately, the parallel adjustment of the rollers of prior art roller grinders is very laborious and time consuming. Typically, the alignment adjustment mechanisms are located on the sides of the roller grinder housing and are often covered by cover panels and drive belt guards. Every time the rollers must be re-aligned, a user has to remove the panels and belt guards to get access to the alignment adjustments of prior art roller grinders. This becomes increasingly more difficult when the roller grinder is located in a very narrow space with little side room around the sides of the roller grinder.

In these respects, the roller alignment system according to the present invention substantially departs from the conventional concepts and designs of the prior art, and in so doing provides an apparatus primarily developed for the purpose of permitting quick and precise parallel alignment of the rollers.

SUMMARY OF THE INVENTION

In view of the foregoing disadvantages inherent in the known types of roller grinders now present in the prior art, the present invention provides a new roller alignment system construction wherein the same can be utilized for permitting quick and precise alignment of the rollers.

The general purpose of the present invention, which will be described subsequently in greater detail, is to provide a new roller alignment system apparatus and method which has many of the advantages of the roller grinders mentioned heretofore and many novel features that result in a new roller alignment system which is not anticipated, rendered obvious, suggested, or even implied by any of the prior art roller grinders, either alone or in any combination thereof.

To attain this, the present invention generally comprises first and second side subassemblies, and an elongate linking rod. Each side subassembly comprises an adjustment bracket and threaded elongate upper and lower adjustment rods. The adjustment bracket is pivotally coupled a side of a roller grinder housing which abuts an end of a back roller of the roller grinder. The back end of the upper first adjustment rod is extended through the upper end of the first adjustment bracket while the front end of the upper first adjustment rod is positioned adjacent the front of the housing. The front end of the lower first adjustment rod is outwardly extended from the front of the housing. A adjustment nut is threaded on the front end of the lower adjustment rod and a coarse adjustment member is coupled to the front end of the upper adjustment rod. The coarse adjustment member is pivotally mounted on a side of the housing. The linking rod connects the coarse adjustment member of the first subassembly to the coarse adjustment member of the second subassembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roller alignment system apparatus and method which has many of the advantages of the roller grinders mentioned heretofore and many novel features that result in a new roller alignment system which is not anticipated, rendered obvious, suggested, or even implied by any of the prior art roller grinders, either alone or in any combination thereof.

It is another object of the present invention to provide a new roller alignment system which may be easily and efficiently manufactured and marketed.

It is a further object of the present invention to provide a new roller alignment system which is of a durable and reliable construction.

An even further object of the present invention is to provide a new roller alignment system which is susceptible of a low cost of manufacture with regard to both materials and labor, and which accordingly is then susceptible of low prices of sale to the consuming public, thereby making such roller alignment system economically available to the buying public.

Still yet another object of the present invention is to provide a new roller alignment system which provides in the apparatuses and methods of the prior art some of the advantages thereof, while simultaneously overcoming some of the disadvantages normally associated therewith.

Still another object of the present invention is to provide a new roller alignment system for permitting quick and precise alignment of the rollers.

Yet another object of the present invention is to provide a new roller alignment system which includes first and second side subassemblies, and an elongate linking rod. Each side subassembly comprises an adjustment bracket and threaded elongate upper and lower adjustment rods. The adjustment bracket is pivotally coupled a side of a roller grinder housing which abuts an end of a back roller of the roller grinder. The back end of the upper first adjustment rod is extended through the upper end of the first adjustment bracket while the front end of the upper first adjustment rod is positioned adjacent the front of the housing. The front end of the lower first adjustment rod is outwardly extended from the front of the housing. An adjustment nut is threaded on the front end of the lower adjustment rod and a coarse adjustment member is coupled to the front end of the upper adjustment rod. The coarse adjustment member is pivotally mounted on a side of the housing. The linking rod connects the coarse adjustment member of the first subassembly to the coarse adjustment member of the second subassembly.

Still yet another object of the present invention is to provide a new roller alignment system that is located on the front of the roller grinder so that the roll alignment adjustments are easy to perform and eliminate the need for a user to access the sides of the roller grinder.

Even still another object of the present invention is to provide a new roller alignment system that is very durable and is strong enough to be used repeatedly and over a long period of time to change the coarseness of the grind of feed by the rollers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic exploded side view of an adjustment bushing of the present invention.

FIG. 6 is a schematic exploded perspective view of a subassembly of the present invention.

DESCRIPTION OF THE PREFERRED EMBODIMENT

Figure 1:
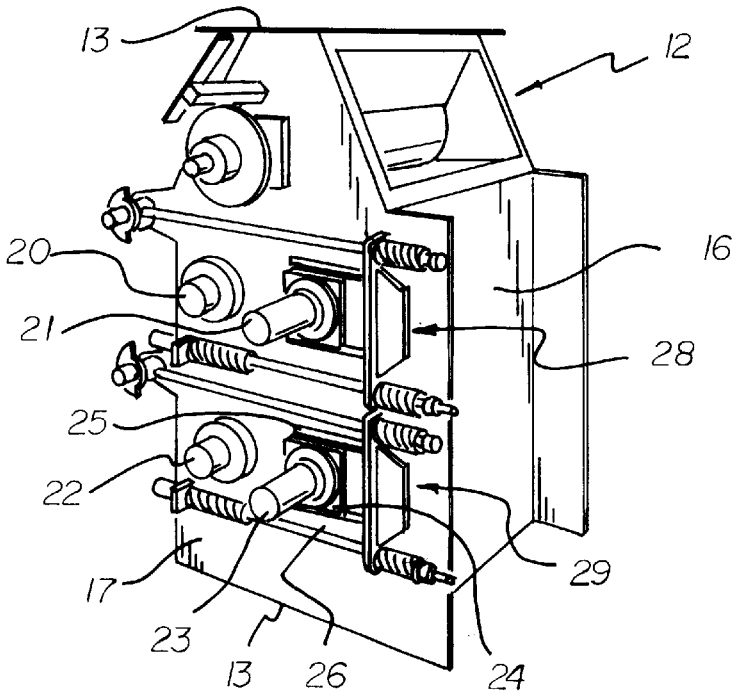
FIG. 1 is a schematic perspective view of a new roller alignment system according to the present invention.

As best illustrated in FIGS. 1 through 7, the roller alignment system generally comprises first and second side subassemblies, and an elongate linking rod. Each side subassembly comprises an adjustment bracket and threaded elongate upper and lower adjustment rods. The adjustment bracket is pivotally coupled a side of a roller grinder housing which abuts an end of a back roller of the roller grinder. The back end of the upper first adjustment rod is extended through the upper end of the first adjustment bracket while the front end of the upper first adjustment rod is positioned adjacent the front of the housing. The front end of the lower first adjustment rod is outwardly extended from the front of the housing. An adjustment nut is threaded on the front end of the lower adjustment rod and a coarse adjustment member is coupled to the front end of the upper adjustment rod. The coarse adjustment member is pivotally mounted on a side of the housing. The linking rod connects the coarse adjustment member of the first subassembly to the coarse adjustment member of the second subassembly.

In closer detail, the system is designed for a roller grinder having a housing 12 with a top 13, a bottom 14, a front 15, a back 16, and first and second sides 17,18. The top 13 of the housing 12 has a grain hopper for permitting pouring of grain into the interior of the housing 12. A pair of upper rollers 20,21 (coarse rollers) and a pair of lower rollers 22,23 (fine rollers) are disposed in the housing 12. The upper rollers 20,21 are positioned towards the top 13 of the housing 12 while the lower rollers 22,23 are positioned between the upper rollers 20,21 and the bottom 14 of the housing 12. Each of the rollers is generally cylindrical and has a pair of opposite ends. Each pair of rollers includes front and back rollers. The front roller 20,22 is positioned towards the front 15 of the housing 12 while the back roller 21,23 is positioned towards the back 16 of the housing 12. Each of the ends of the front roller is rotationally mounted to an associated side of the housing 12 to permit free rotation about the longitudinal axis of the roller with one of the ends of the front roller rotationally mounted to the first side 17 of the housing 12 and another of the ends of the front roller rotationally mounted to the second side 18 of the housing 12. Similarly, each of the ends of the back roller is rotationally mounted to an associated side of the housing 12. Each of the ends of the back roller is also slidably mounted to the associated side of the housing 12 by a slide plate 24 mounted to a pair of upper and lower rails 25,26 to permit sliding of the roller between the front 15 and back 16 of the housing 12. Specifically, a first of the ends of the back roller is rotationally and slidably mounted to the first side 17 of the housing 12 while a second of the ends of the back roller is rotationally and slidably mounted to the second side 18 of the housing 12.

The system also includes upper and lower roller adjustment assemblies 28,29. The upper roller adjustment assembly 28 is designed for adjusting the spacing between the pair of upper rollers and the lower roller adjustment assembly 29 is designed for adjusting the spacing between the pair of lower rollers. Each the roller adjustment assembly comprises a first side subassembly 30, a second side subassembly 40, and an elongate linking rod 50.

The first side subassembly 30 includes a first adjustment bracket 31 having upper and lower ends. The first adjustment bracket 31 abuts the first end of the back roller 21 and is pivotally coupled to the first side 17 of the housing 12 at a point 35 between the ends of the first adjustment bracket 31. The first side subassembly also includes threaded elongate upper and lower first adjustment rods 32,33 each having front and back ends and threads along their entire length. The back end of the upper first adjustment rod 32 is extended through the upper end of the first adjustment bracket 31 such that the upper first adjustment rod 32 is coupled to the upper end of the first adjustment bracket. The front end of the upper first adjustment rod 32 is positioned adjacent the front 15 of the housing 12.

The first side 17 of the housing 12 has an holding tab 34 with a hole through it. The holding tab 34 is positioned towards the front 15 of the housing 12. The back end of the lower first adjustment rod 33 is extended through the lower end of the first adjustment bracket 31 such that the lower first adjustment rod 33 is coupled to the lower end of the first adjustment bracket. The lower first adjustment rod 33 is extended through the holding tab 34 of the first side 17 of the housing 12 so that the front end of the lower first adjustment rod 33 outwardly extends from the front 15 of the housing 12. A first adjustment nut 36 is threaded on the front end of the lower first adjustment rod 33. Preferably, a first adjustment bushing 58 is disposed around the lower first adjustment rod 33 between the holding tab 34 of the first side and the first adjustment nut 36 such that the first adjustment bushing 58 abuts the holding tab 34 of the first side and the first adjustment nut 36. The first adjustment bushing 58 preferably comprises a first and second sleeve 60,61 coupled together and a plurality of bushing washers 62,64 and a thrust bearing 63.

A first coarse adjustment member 37 is coupled to the front end of the upper first adjustment rod 32. The first coarse adjustment member 37 is pivotally mounted on the first side 17 of the housing 12. The first coarse adjustment member 37 of each subassembly has a coarse adjustment handle 38 to permit pivoting of the first coarse adjustment member 37 and a holding device 39 for holding the first coarse adjustment 37 in a position. A first spring 51 is disposed around the lower first adjustment rod 33 between the upper holding tab 34 of the first side 17 of the housing 12 and a nut threaded on the lower first adjustment rod 33 between the holding tab 34 of the first side 17 of the housing 12 and the first adjustment bracket 31. A second spring 52 is disposed around the lower first adjustment rod 33 between the first adjustment bracket 31 and a nut on the back end of the lower first adjustment rod 33. A third spring 53 is disposed around the upper first adjustment rod 32 between the first adjustment bracket 31 and a nut on the back end of the upper first adjustment rod 32. The first, second and third springs 51,52,53 of the first side subassembly 30 are designed for biasing the pivoting of the first mounting bracket in a direction opposite the direction the first mounting bracket is pivoted when the first adjustment nut 36 is tightened on the lower first adjustment rod 33 towards the holding tab 34 of the first side 17 of the housing 12.

Figure 2:
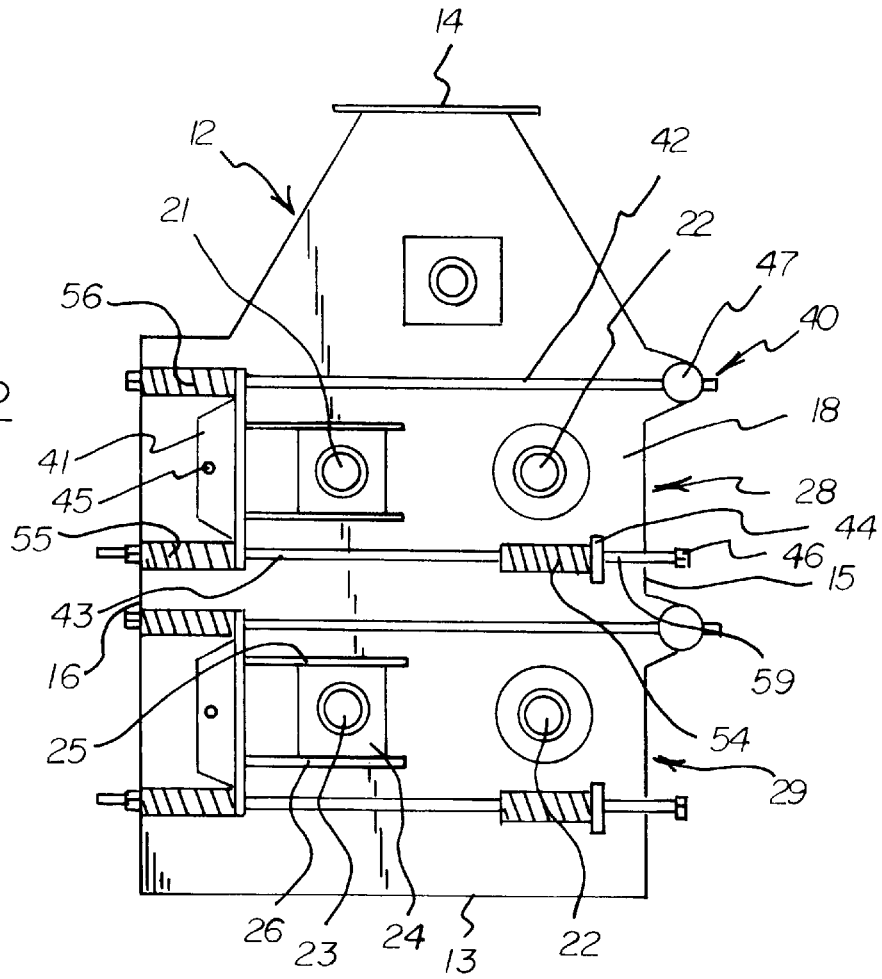
FIG. 2 is a schematic second side view of the present invention.
Figure 3:
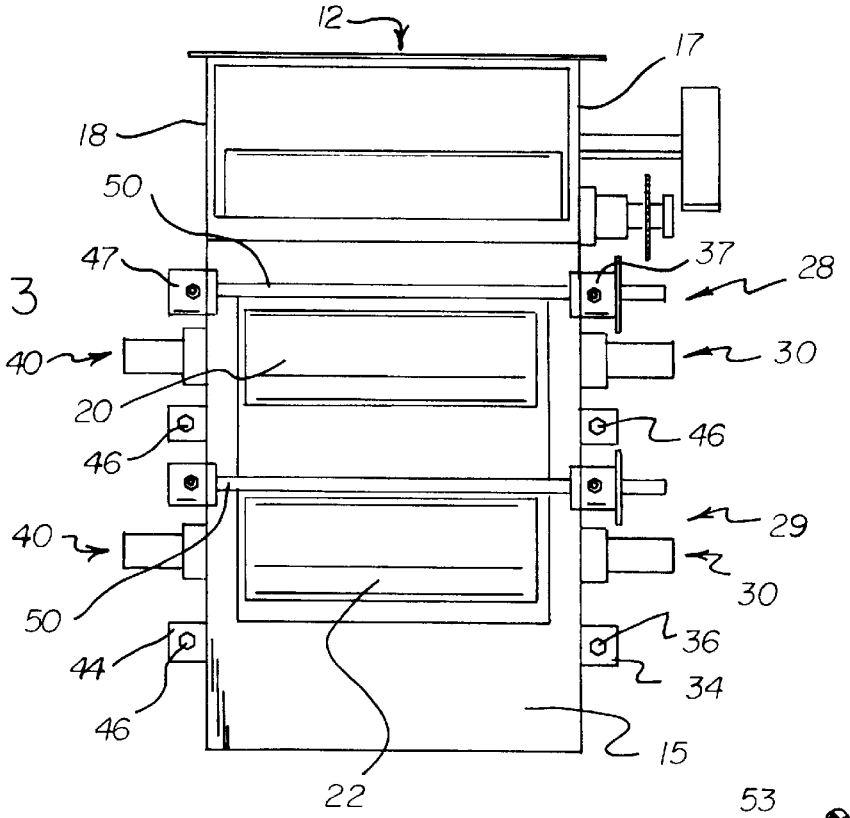
FIG. 3 is a schematic front side view of the present invention.
Figure 4:
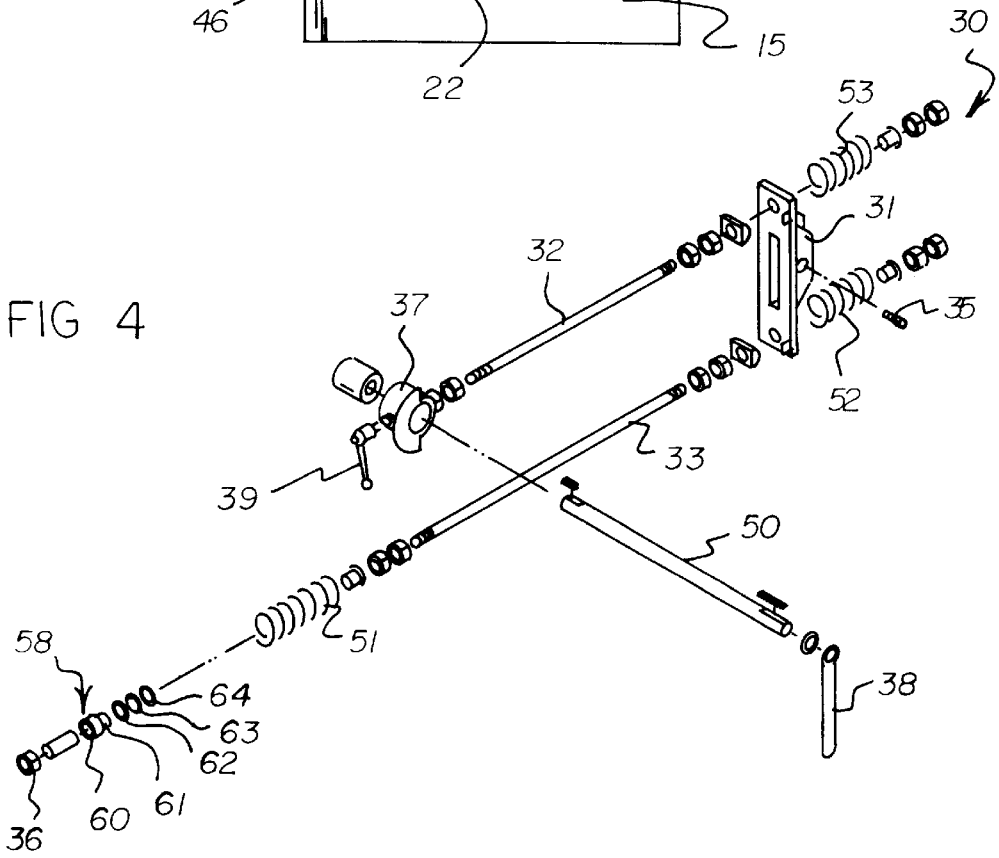
FIG. 4 is a schematic exploded perspective view of a subassembly of the present invention.

Similar to the first side subassembly, the second side subassembly 40 includes a second adjustment bracket 41 has upper and lower ends. As illustrated in FIG. 2 and like the first adjustment bracket, the second adjustment bracket 41 abuts the second end of the back roller. The second adjustment bracket 41 is pivotally coupled to the second side 18 of the housing 12 at a point 45 between the ends of the second adjustment bracket 41. Threaded elongate upper and lower second adjustment rods 42,43 are provided each having front and back ends and threads preferably along their entire length. The back end of the upper second adjustment rod 42 is extended through the upper end of the second adjustment bracket 41 such that the upper second adjustment rod 42 is coupled to the upper end of the second adjustment rod. The front end of the upper second adjustment rod 42 is positioned adjacent the front 15 of the housing 12.

The second side 18 of the housing 12 has an holding tab 44 has a hole therethrough. The holding tab 44 of the second side is positioned towards the front 15 of the housing 12. The back end of the lower second adjustment rod 43 is extended through the lower end of the second adjustment bracket 41 such that the lower second adjustment rod 43 is coupled to the lower end of the second adjustment rod. The lower second adjustment rod 43 is extended through the holding tab 44 of the second side 18 of the housing 12 so that the front end of the lower second adjustment rod 43 outwardly extends from the front 15 of the housing 12. A second adjustment nut 46 is threaded on the front end of the lower second adjustment rod 43. Like the first adjustment bushing, second adjustment bushing 59 is disposed around the lower second adjustment rod 43 between the holding tab 44 of the second side and the second adjustment nut 46 such that the second adjustment bushing 59 abuts the holding tab 44 of the second side and the second adjustment nut 46.

A second coarse adjustment 47 member is coupled to the front end of the upper second adjustment rod 42. The second coarse adjustment 47 member is pivotally mounted on the second side 18 of the housing 12. A fourth spring 54 is disposed around the lower second adjustment rod 43 between the holding tab 44 of the second side 18 of the housing 12 and a nut threaded on the lower second adjustment rod 43 between the holding tab 44 of the second side 18 of the housing 12 and the second adjustment bracket 41. A fifth spring 55 is disposed around the lower second adjustment rod 43 between the second adjustment bracket 41 and a nut on the back end of the lower second adjustment rod 43. A sixth spring 56 is disposed around the upper second adjustment rod 42 between the second adjustment bracket 41 and a nut on the back end of the upper second adjustment rod 42. The fourth, fifth, and sixth springs 54,55,56 of the second side subassembly 40 are designed for biasing the pivoting of the second mounting bracket in a direction opposite the direction the second mounting bracket is pivoted when the second adjustment nut 46 is tightened on the lower second adjustment rod 43 towards the holding tab 44 of the second side 18 of the housing 12.

The linking rod 50 connects the first coarse adjustment member to the second coarse adjustment member so that both ends the front roll are spread apart from the back role when the coarse adjustment member is pivoted by the handle 38. The linking rod 50 is located adjacent the front 15 of the housing 12.

Figure 7:
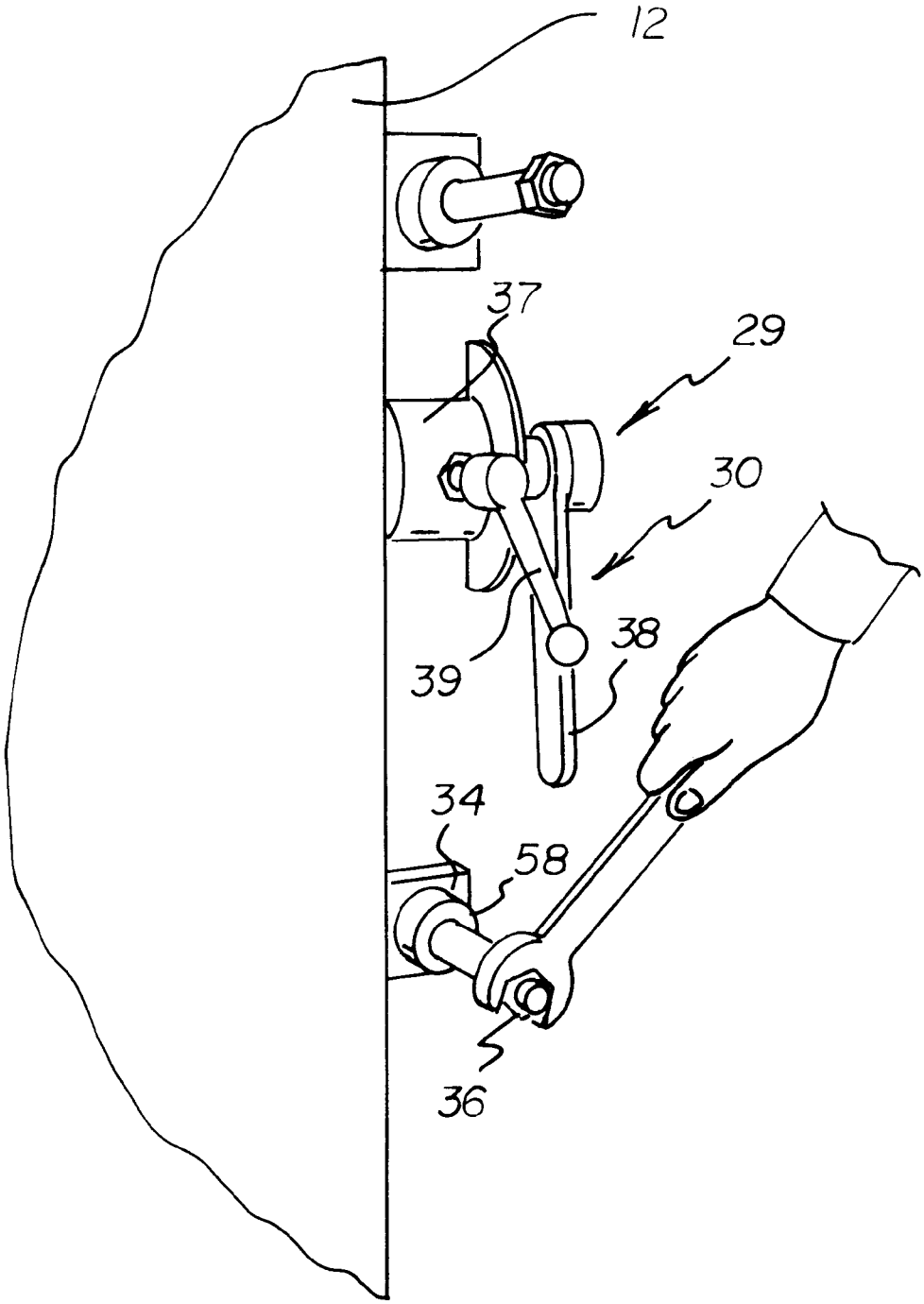
FIG. 7 is a schematic view of the present invention illustrating the turning of adjustment nut.

In use, the system is used for parallel alignment adjustment of the distance between the respective pair of front and back rollers. As illustrated in FIG. 7, the adjustment nut 36 is turned on the front end of the lower adjustment rod to pivot the associated side subassembly so that the associated ends of the pair of rollers are spaced apart from each other at a distance corresponding to the number of turns of the adjustment nut on the lower adjustment rod. The second adjustment nut 46 is correspondingly turned on the lower adjustment rod 43 of the second side subassembly so that the second ends of the rollers are spaced apart from each other the same distance as the first ends thereby making the front and back rollers parallel with one another at a proscribed distance from each other.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roller grinder, comprising:

a housing having a top, a bottom, a front, a back, and first and second sides;

a pair of rollers disposed in said housing, wherein said pair of rollers comprises:

front and back rollers, each of said rollers being generally cylindrical and having a pair of opposite ends, said front roller being positioned towards said front of said housing, said back roller being positioned towards said back of said housing;

each of said ends of said front roller being rotationally mounted to an associated side of said housing;

each of said ends of said back roller being rotationally mounted to an associated side of said housing, each of said ends of said back roller being slidably mounted to the associated side of said housing to permit sliding of said roller between said front and back of said housing;

an adjustment assembly for adjusting the spacing between said pair of rollers, wherein said roller adjustment assembly comprises a first side subassembly, a second side subassembly, and an elongate linking rod;

said first side subassembly comprising:

a first adjustment bracket having upper and lower ends, said first adjustment bracket abutting said first end of said back roller, said first adjustment bracket being pivotally coupled to said first side of said housing at a point between said ends of said first adjustment bracket;

threaded elongate upper and lower first adjustment rods each having front and back ends;

said back end of said upper first adjustment rod being extended through said upper end of said first adjustment bracket, said front end of said upper first adjustment rod being positioned adjacent said front of said housing;

said first side of said housing having a holding tab, said holding tab being positioned towards said front of said housing;

said back end of said lower first adjustment rod being extended through said lower end of said first adjustment bracket, said lower first adjustment rod being extended through said holding tab of said first side of said housing, said front end of said lower first adjustment rod being outwardly extended from said front of said housing;

a first adjustment nut being threaded on said front end of said lower first adjustment rod; and a first coarse adjustment member being coupled to said front end of said upper first adjustment rod, said first coarse adjustment member being pivotally mounted on said first side of said housing;

said second side subassembly comprising:

a second adjustment bracket having upper and lower ends, said second adjustment bracket abutting said second end of said back roller, said second adjustment bracket being pivotally coupled to said second side of said housing at a point between said ends of said second adjustment bracket;

threaded elongate upper and lower second adjustment rods each having front and back ends;

said back end of said upper second adjustment rod being extended through said upper end of said second adjustment bracket, said front end of said upper second adjustment rod being positioned adjacent said front of said housing;

said second side of said housing having a holding tab, said holding tab of said second side being positioned towards said front of said housing;

said back end of said lower second adjustment rod being extended through said lower end of said second adjustment bracket, said lower second adjustment rod being extended through said holding tab of said second side of said housing, said front end of said lower second adjustment rod being outwardly extended from said front of said housing;

a second adjustment nut being threaded on said front end of said lower second adjustment rod; and a second coarse adjustment member being coupled to said front end of said upper second adjustment rod, said second coarse adjustment member being pivotally mounted on said second side of said housing; and said linking rod connecting said first coarse adjustment member to said second coarse adjustment member, said linking rod being located adjacent said front of said housing.

2. The roller grinder of claim 1, wherein said first side subassembly further includes a first adjustment bushing being disposed around said lower first adjustment rod between said holding tab of said first side and said first adjustment nut such that said first adjustment bushing abuts said holding tab of said first side and said first adjustment nut, and wherein said second side subassembly further includes a second adjustment bushing being disposed around said lower second adjustment rod between said holding tab of said second side and said second adjustment nut such that said second adjustment bushing abuts said holding tab of said second side and said second adjustment nut.

3. The roller grinder of claim 1, wherein said first side subassembly comprises a first spring being disposed around said lower first adjustment rod between said upper holding tab of said first side of said housing and a nut threaded on said lower first adjustment rod between said holding tab of said first side of said housing and said first adjustment bracket;

a second spring being disposed around said lower first adjustment rod between said first adjustment bracket and said back end of said lower first adjustment rod;

a third spring being disposed around said upper first adjustment rod between said first adjustment bracket and said back end of said upper first adjustment rod; and said first, second and third springs of said first side subassembly being for biasing the pivoting of said first mounting bracket in a direction opposite the direction said first mounting bracket is pivoted when said first adjustment nut is tightened on said lower first adjustment rod towards said holding tab of said first side of said housing.

4. The roller grinder of claim 3, wherein said second side subassembly comprises a fourth spring being disposed around said lower second adjustment rod between said holding tab of said second side of said housing and a nut threaded on said lower second adjustment rod between said holding tab of said second side of said housing and said second adjustment bracket;

a fifth spring being disposed around said lower second adjustment rod between said second adjustment bracket and said back end of said lower second adjustment rod;

a sixth spring being disposed around said upper second adjustment rod between said second adjustment bracket and said back end of said upper second adjustment rod;

said fourth, fifth, and sixth springs of said second side subassembly being for biasing the pivoting of said second mounting bracket in a direction opposite the direction said second mounting bracket is pivoted when said second adjustment nut is tightened on said lower second adjustment rod towards said holding tab of said second side of said housing.

5. A roller grinder, comprising:

a housing having a top, a bottom, a front, a back, and first and second sides;

a pair of upper rollers and a pair of lower rollers disposed in said housing, said upper rollers being positioned towards said top of said housing, said lower rollers being positioned between said upper rollers and said bottom of said housing;

wherein each pair of rollers comprises:

front and back rollers, each of said rollers being generally cylindrical and having a pair of opposite ends, said front roller being positioned towards said front of said housing, said back roller being positioned towards said back of said housing;

each of said ends of said front roller being rotationally mounted to an associated side of said housing, one of said ends of said front roller being rotationally mounted to said first side of said housing, another of said ends of said front roller being rotationally mounted to said second side of said housing; and each of said ends of said back roller being rotationally mounted to an associated side of said housing, each of said ends of said back roller being slidably mounted to the associated side of said housing to permit sliding of said roller between said front and back of said housing, a first of said ends of said back roller being rotationally and slidably mounted to said first side of said housing, a second of said ends of said back roller being rotationally and slidably mounted to said second side of said housing;

upper and lower roller adjustment assemblies, said upper roller adjustment assembly being for adjusting the spacing between said pair of upper rollers, said lower roller adjustment assembly being for adjusting the spacing between said pair of lower rollers;

wherein each said roller adjustment assembly comprises a first side subassembly, a second side subassembly, and an elongate linking rod;

said first side subassembly comprising:

a first adjustment bracket having upper and lower ends, said first adjustment bracket abutting said first end of said back roller, said first adjustment bracket being pivotally coupled to said first side of said housing at a point between said ends of said first adjustment bracket;

threaded elongate upper and lower first adjustment rods each having front and back ends;

said back end of said upper first adjustment rod being extended through said upper end of said first adjustment bracket, said front end of said upper first adjustment rod being positioned adjacent said front of said housing;

said first side of said housing having a holding tab, said holding tab being positioned towards said front of said housing;

said back end of said lower first adjustment rod being extended through said lower end of said first adjustment bracket, said lower first adjustment rod being extended through said holding tab of said first side of said housing, said front end of said lower first adjustment rod being outwardly extended from said front of said housing;

a first adjustment nut being threaded on said front end of said lower first adjustment rod;

a first adjustment bushing being disposed around said lower first adjustment rod between said holding tab of said first side and said first adjustment nut such that said first adjustment bushing abuts said holding tab of said first side and said first adjustment nut;

a first coarse adjustment member being coupled to said front end of said upper first adjustment rod, said first coarse adjustment member being pivotally mounted on said first side of said housing;

a first spring being disposed around said lower first adjustment rod between said upper holding tab of said first side of said housing and a nut threaded on said lower first adjustment rod between said holding tab of said first side of said housing and said first adjustment bracket;

a second spring being disposed around said lower first adjustment rod between said first adjustment bracket and said back end of said lower first adjustment rod;

a third spring being disposed around said upper first adjustment rod between said first adjustment bracket and said back end of said upper first adjustment rod; and said first, second and third springs of said first side subassembly being for biasing the pivoting of said first mounting bracket in a direction opposite the direction said first mounting bracket is pivoted when said first adjustment nut is tightened on said lower first adjustment rod towards said holding tab of said first side of said housing;

said second side subassembly comprising:

a second adjustment bracket having upper and lower ends, said second adjustment bracket abutting said second end of said back roller, said second adjustment bracket being pivotally coupled to said second side of said housing at a point between said ends of said second adjustment bracket;

threaded elongate upper and lower second adjustment rods each having front and back ends;

said back end of said upper second adjustment rod being extended through said upper end of said second adjustment bracket, said front end of said upper second adjustment rod being positioned adjacent said front of said housing;

said second side of said housing having a holding tab, said holding tab of said second side being positioned towards said front of said housing;

said back end of said lower second adjustment rod being extended through said lower end of said second adjustment bracket, said lower second adjustment rod being extended through said holding tab of said second side of said housing, said front end of said lower second adjustment rod being outwardly extended from said front of said housing;

a second adjustment nut being threaded on said front end of said lower second adjustment rod;

a second adjustment bushing being disposed around said lower second adjustment rod between said holding tab of said second side and said second adjustment nut such that said second adjustment bushing abuts said holding tab of said second side and said second adjustment nut;

a second coarse adjustment member being coupled to said front end of said upper second adjustment rod, said second coarse adjustment member being pivotally mounted on said second side of said housing;

a fourth spring being disposed around said lower second adjustment rod between said holding tab of said second side of said housing and a nut threaded on said lower second adjustment rod between said holding tab of said second side of said housing and said second adjustment bracket;

a fifth spring being disposed around said lower second adjustment rod between said second adjustment bracket and said back end of said lower second adjustment rod;

a sixth spring being disposed around said upper second adjustment rod between said second adjustment bracket and said back end of said upper second adjustment rod; and said fourth, fifth, and sixth springs of said second side subassembly being for biasing the pivoting of said second mounting bracket in a direction opposite the direction said second mounting bracket is pivoted when said second adjustment nut is tightened on said lower second adjustment rod towards said holding tab of said second side of said housing; and said linking rod connecting said first coarse adjustment member to said second coarse adjustment member, said linking rod being located adjacent said front of said housing.

* * * * *